US005482476A

United States Patent [19]

Watanabe et al.

[11] Patent Number: 5,482,476

[45] Date of Patent: Jan. 9, 1996

[54] PANEL-MOUNTED ELECTRICAL CONNECTOR

[75] Inventors: Kaoru Watanabe; Hajime Kawase, both of Mie, Japan

[73] Assignee: Sumitomo Wiring Systems, Ltd., Mie, Japan

[21] Appl. No.: 208,277

[22] Filed: Mar. 10, 1994

[30] Foreign Application Priority Data

Mar. 11, 1993 [JP] Japan ..... 5-016909 U

[51] Int. Cl.[6] ..... H01R 13/74

[52] U.S. Cl. ..... 439/555

[58] Field of Search ..... 439/555, 557, 439/558, 352

[56] References Cited

U.S. PATENT DOCUMENTS 3,439,312 4/1969 Greasley ..... 439/555
5,389,015 2/1995 Sasai et al. ..... 439/555

FOREIGN PATENT DOCUMENTS 54-116694 9/1979 Japan .
3-55263 12/1991 Japan .
5-87844 11/1993 Japan .

*Primary Examiner*—Gary F. Paumen
*Attorney, Agent, or Firm*—Wenderoth, Lind & Ponack

[57] ABSTRACT

An electrical connector attached to a door or body panel of an automobile for wiring electrical parts includes a body having a front opening and holding, in it, terminals capable of fitting with counterpart terminals, respectively. A pair of locking arms each capable of flexing inwardly are provided at the outer periphery of the body. Each locking arm has a concave-convex engagement structure engaged with an edge of the panel defining a mounting hole when the connector is inserted into the mounting hole. A pair of deformation preventing portions are formed to the inside of the locking arms to be engaged with the locking arms, respectively. The deformation preventing portions prevent deformation of the locking arms by engaging the locking arms, respectively. The locking arms engage the respective deformation preventing portions when something strikes against the locking arms and the locking arms are flexed inwardly. Each locking arm will not, however, flex excessively due to its engagement with a deformation preventing portion, thereby being protected.

5 Claims, 7 Drawing Sheets

PANEL-MOUNTED ELECTRICAL CONNECTOR

BACKGROUND OF THE INVENTION

1. Field of the Invention

This invention relates to a panel-mounted electrical connector having elastic locking arms on its outer periphery, and more particularly to such a connector wherein each locking arm flexes inwardly at an edge of a mounting hole formed in a panel when the connector is inserted into the mounting hole and each locking arm returns to its normal shape to engage the panel when the connector has been inserted into the hole to assume a normal position.

2. Description of the Prior Art

The electrical connector mentioned above includes those attached to panels composing a door or a body of an automobile so that electric parts equipped in the door are connected to the body side. FIG. 9 illustrates a conventional panel-mounted electrical connector 1. The connector 1 includes a front bottomed cylindrical hood 2. A plurality of male terminals 3 are held on a inner wall of the hood 2 so as to project toward its front open end. A flange 4 is formed on the outer periphery near the front end of the hood 2. When the connector 1 is inserted into a mounting hole W of a panel P, the flange 4 collides against panel P. A pair of slit-like notched portions are formed in each of upper and lower walls to extend from the open end toward the inner wall. Two locking arms 5 each formed into the shape of a plate with a small width and having elasticity are provided between the respective pairs of notched portions. Each locking arm 5 has a protrusion 6 formed on the outer peripheral side of its distal end. Each protrusion 6 has an inclined front side and a rear vertical end. A distance between the rear vertical wall surface and the front end wall surface of the flange 4 is so set as to be approximately equal to the thickness of the panel P.

When the above-described connector 1 is inserted into the mounting hole W of the panel P, the front end of each protrusion 6 collides against the edge of the panel P defining the hole W such that each locking arm 5 flexes inwardly. When the connector 1 is further inserted into the hole W such that the front wall surface of the flange 4 collides against the panel P, each protrusion 6 passes through the panel P, whereupon each locking arm 5 returns to its normal shape. The panel P is then held between the rear vertical wall surface of each protrusion 6 and the front wall surface of the flange 4, whereby the connector 1 is held on the panel P.

Since the male connectors 3 project in the hood 2, something can invade the hood 2 to strike against the male connectors 3 during transportation such that some or all the male connectors 3 bend. To prevent this, a protecting cap 7 (FIG. 10) is attached to the open end of the hood 2 to preliminarily close the end. The protecting cap 7 is inserted into the open end of the hood 2 so that the connector 1 with the cap 7 being attached thereto can be mounted on the panel P. Accordingly, the locking arms 5 are still exposed. Female connectors 8 are inserted into the hood 2 from the side of the connector 1 opposed to the direction in which it is inserted into the mounting hole W.

Although the male terminals 3 can be protected by the protecting cap 7, there is a possibility that something can strike against the locking arms 5 despite the provision of the protecting cap 7. Since each locking arm 5 has elasticity, it can return to its normal shape even when bending to an extent of its bending strength. However, each locking arm 5 cannot return to its normal shape when subjected to a force exceeding the limit of its bending strength, as shown by two-dot chain line in FIG. 10, which poses a problem.

SUMMARY OF THE INVENTION

Therefore, an object of the present invention is to provide a panel-mounted electrical connector wherein the locking arms can be protected.

Another object of the invention is to provide a panel-mounted electrical connector wherein the mounting of the connector is not prevented by deformation preventing portions provided for protecting the locking arms.

Further, another object of the invention is to provide a panel-mounted electrical connector wherein the locking arms can be protected by a protecting cap provided for protecting terminals.

Further, another object of the invention is to provide a panel-mounted electrical connector wherein the protecting cap can be attached to the connector by use of the deformation preventing portions.

Further, another object of the invention is to provide a panel-mounted electrical connector wherein an engagement structure for engaging the panel can be provided for the shape of the deformation preventing portions each formed so as to project.

Further, another object of the invention is to provide a panel-mounted electrical connector wherein the deformation preventing portions each having the engagement structure can be readily attached to the connector.

The present invention provides an electrical connector comprising a body having a front opening and holding therein a plurality of terminals capable of fitting with counterpart terminals, respectively, a pair of locking arms each capable of flexing inwardly and outwardly and held on the outer periphery of the body, each locking arm having a concave-convex engagement structure receiving an edge of a panel defining a mounting hole when the connector is inserted into the mounting hole, and a pair of deformation preventing portions provided on the inside of the locking arms, respectively, the deformation preventing portions restricting deformation of the locking arms by engaging the locking arms, respectively when the locking arms are flexed inwardly by an amount greater than a certain extent. Each deformation preventing portion can be part of the connector body or can be part of an external cap attached to the connector body. Each deformation preventing portion can be detachable when it is not necessary.

Even when something external strikes against the locking arms, the locking arms engage the respective deformation preventing portions such that the flection of each locking arm is restricted. Consequently, each locking arm is not forced to flex excessively and accordingly, can return to its normal shape.

A gap may be defined between each deformation preventing portion and the inside of the corresponding locking arm, each gap allowing the corresponding locking arm to flex when the concave-convex engagement structure of each locking arm is engaged with the edge defining the mounting hole.

Each locking arm can flex to some extent despite the provision of the deformation preventing portions. Accordingly, each locking arm can flex inwardly away from the edge defining the mounting hole when the connector is inserted into the mounting hole. Consequently, the mounting of the connector is not prevented by the deformation preventing portions.

Each deformation preventing portion may be formed on a protecting cap attached to the open end of the body of the connector. In this construction, the deformation preventing portions are located inside the respective locking arms when the protecting cap is attached to the open end of the connector body. The deformation preventing portions engage the respective locking arms when the locking arms are pushed inwardly to a certain extent, thereby preventing excessive forced flection.

Each deformation preventing portion formed on the protecting cap may project inside of the connector body and has an engagement structure engaging the connector body inside the open end of the connector body. The deformation preventing portions are located within the connector body when the protecting cap is attached to the connector body. Each deformation preventing portion then engages the inside of the connector, whereby the deformation preventing portions are engaged with the connector at locations inside of the connector body. Since the protecting cap is held on the connector, the deformation preventing portions and the engagement structure need not be separately formed. Furthermore, since the deformation preventing portions are inserted deeply within the connector body and engage it, the protecting cap can be securely held.

Each deformation preventing portion may have a resilient distal end and an engagement structure at the distal end, the engagement structure engaging the inner peripheral surface of the connector body. When each deformation preventing portion is inserted through the open end of the connector body, the distal end thereof engages the inner peripheral surface of the connector body to flex. Each deformation preventing portion can be readily provided with elasticity when it is formed in the shape of a thin plate.

Each locking arm may have an inside surface defining a guide groove guiding the engagement structure of a deformation preventing portion into the connector body. Each deformation preventing portion is inserted along the inside of the locking arm. In this case, an inclined guide formed on the inside of each locking arm defines the guide groove so that each deformation preventing portion is guided to its normal position.

BRIEF DESCRIPTION OF THE DRAWINGS

Other objects, features and advantages of the present invention will become clear upon reviewing the following description of the preferred embodiments thereof, made with reference to the accompanying drawings, in which.

DETAILED DESCRIPTION OF THE PREFERRED EMBODIMENTS

Figure 1:
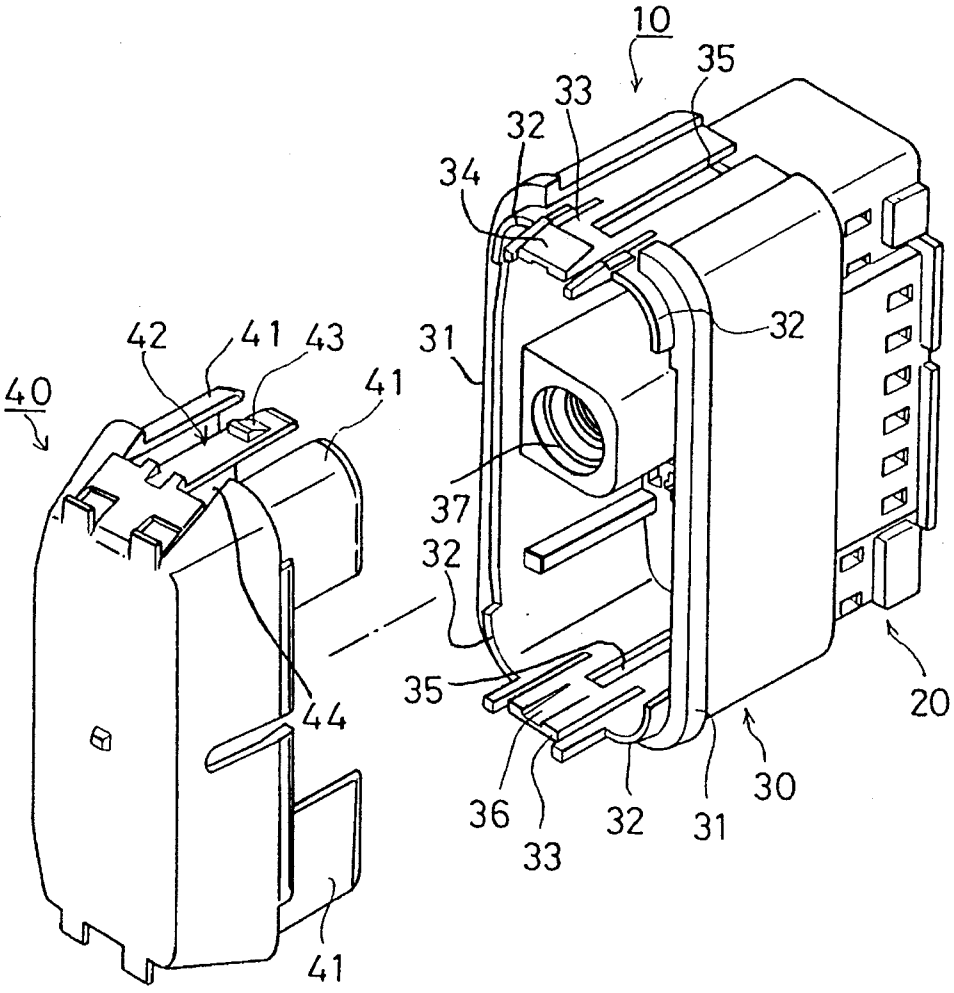
FIG. 1 is a perspective view of a first embodiment of a panel-mounted electrical connector and a protecting cap unattached to the connector in accordance with the present invention.
Figure 2:
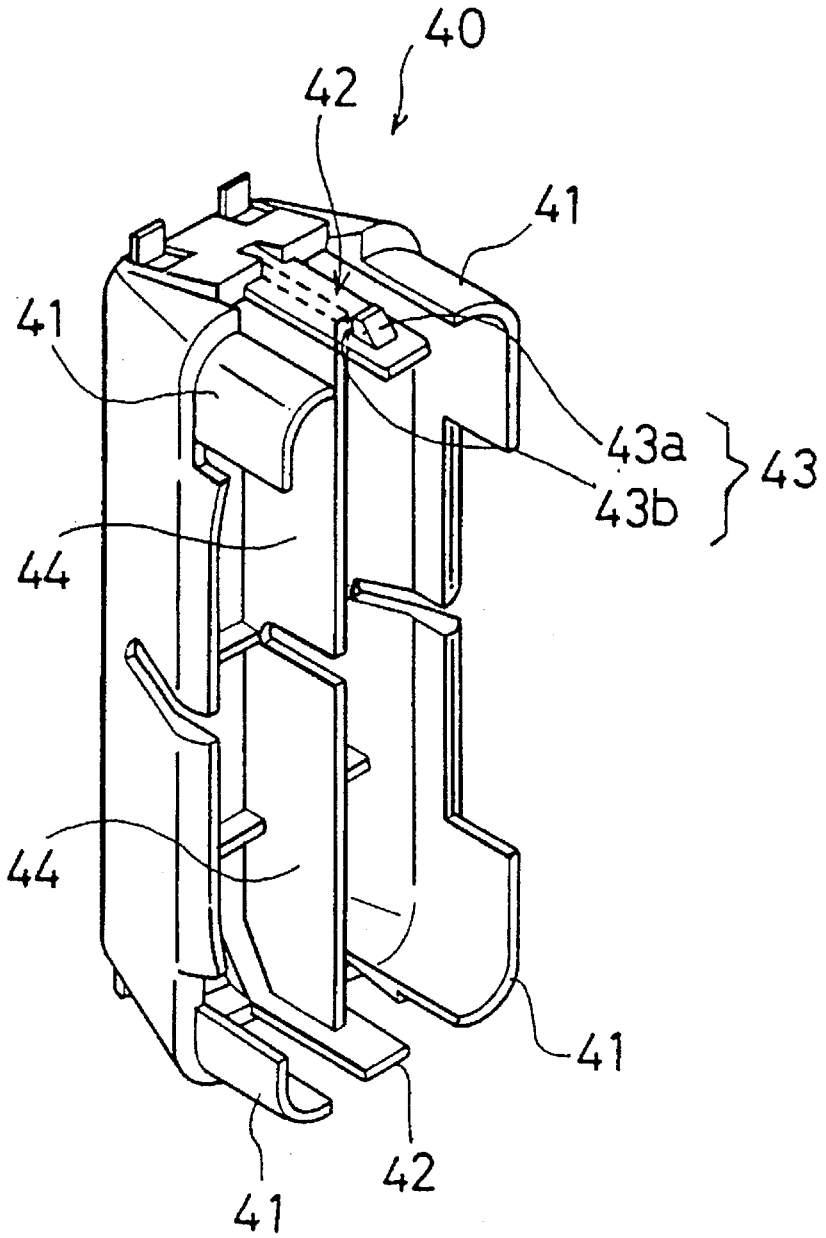
FIG. 2 is a perspective view of the protecting cap.
Figure 3:
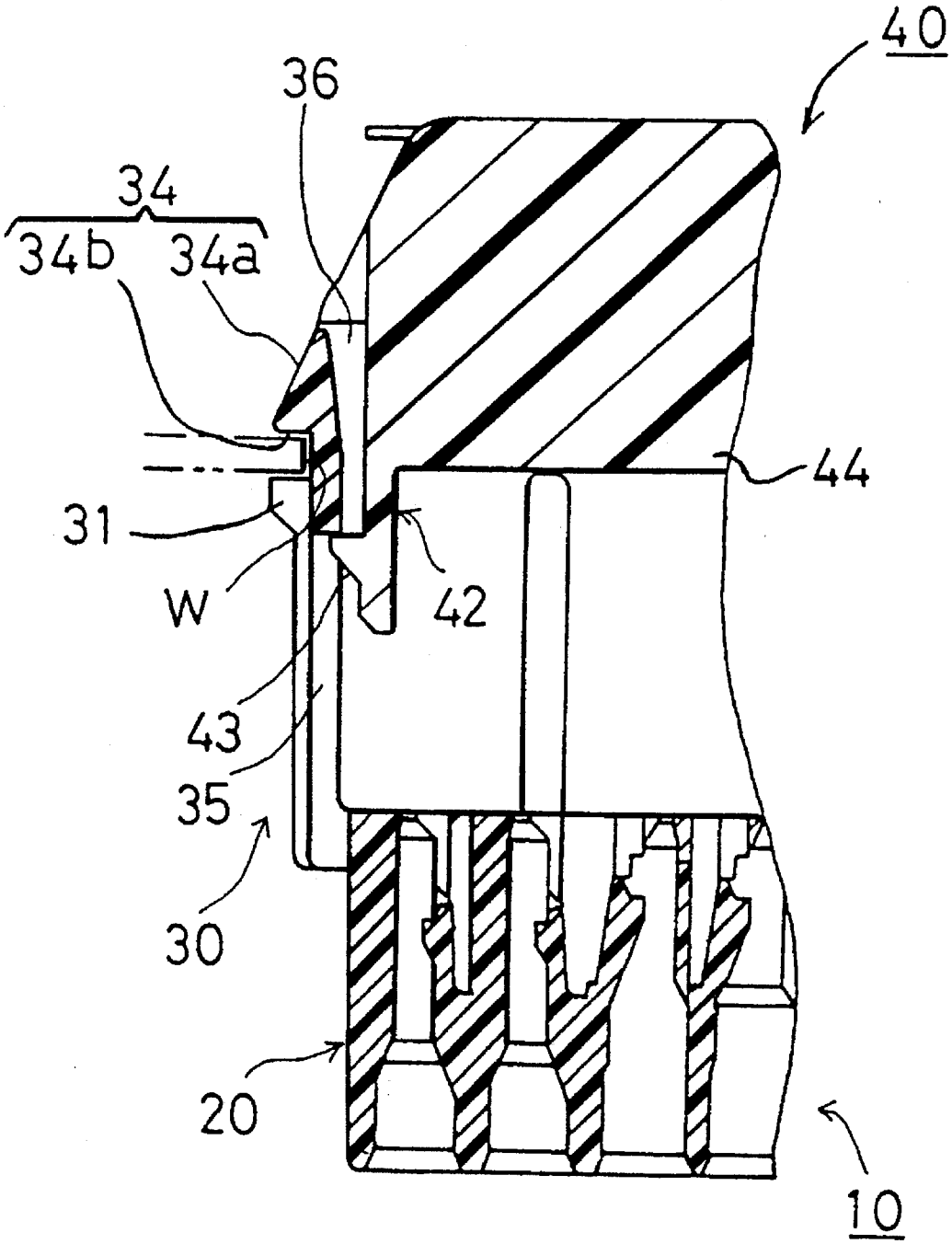
FIG. 3 is a partial sectional view of the connector and the protecting cap is attached to the connector.

A first embodiment of the present invention will be described with reference to FIGS. 1 to 3. In the first embodiment, the invention is applied to a male connector used in the automobile. The panel-mounted connector 10 comprises a generally rectangular body 20 holding thereon a plurality of male terminals (not shown). The body 20 includes a forwardly projecting generally cylindrical hood 30 surrounding portions of the male terminals fitted with female terminals (not shown). The size of the hood 30 is set so that the female terminals can be inserted thereinto. The female terminals are inserted into the hood 30 to be connected to the respective male terminals.

The hood 30 has a rectangular section with rounded corners. The hood 30 has an open end and a flange 31 formed on the outer periphery of the open end thereof except at the central portions of the upper and lower walls. Four plate-like positioning ribs 32 extend outward from the respective corners of the hood 30. Two plate-like locking arms 33 are formed on the central portions of the upper and lower walls of the hood 30 where the flange 31 is not formed. The locking arms 33 project slightly forward relative to the positioning ribs 32. Each locking arm 33 has an engagement protrusion 34 formed on the outer peripheral surface of its distal end. Each engagement protrusion 34 includes an inclined surface **34*a* gradually projecting outward and a vertical wall surface 34*b* formed at the terminal of the inclined surface 34*a*. The distance between the vertical wall surface 34*b* and the flange 31 is approximately equal to the thickness of a panel P. The hood 30 is cut so that the locking arms 33** flex readily.

When the connector 10 is inserted into a mounting hole W of the panel P from the side of the hood 30, the inclined surface **34*a* of the engagement protrusion 34 of each locking arm 33 abuts against the edge of the mounting hole W. When the connector 10 is further inserted into the hole W, each locking arm 33 flexes inwardly. Upon flection of each locking arm 33, the positioning ribs invade the hole W, abutting against the edge of the hole W from the inside and positioning the connector 10. When the connector 10 is inserted until the flange 31 abuts against the panel P, the vertical wall surface 34*b* of the engagement protrusion 34 of each locking arm 33 is located at the side of the opposite surface of the panel P. Each locking arm 33 having flexed returns to its normal shape, as shown in FIG. 3, whereby the panel P is held between the engagement protrusions 34 and the flange 31 and the locking arms 33** engage the panel P.

A protecting cap 40 is attached to the hood 30 of the connector 10 to close the open end, thereby protecting the male terminals held in the hood 30. Since the protecting cap 40 closes the hood 30, the sectional configuration of the attached end thereof is the same as that of the open end of the hood 30. The protecting cap 40 generally has the shape of a dome with a tapered forward end. The protecting cap 40 is designed not to project outward of the positioning ribs 32 and to pass through the mounting hole W of the panel P.

The protecting cap 40 has four plate-like mounting ribs 41 formed to project from four corners of the side thereof from which the cap 40 is attached to the hood 30, respectively. The mounting ribs 41 are inserted along the inner surfaces of the respective positioning ribs 32. The protecting cap 40 further has two plate-like deformation preventing portions 42 formed on the central portions of the respective upper and lower walls. Each deformation preventing portion 42 projects toward the side of the hood 30 as between the mounting ribs 41. The deformation preventing portions 42 correspond to the respective locking arms 33. Ribs 44 are formed between the deformation preventing portions 42 on the inner surface of the protecting cap 40 so that the deformation preventing portions 42 are reinforced.

The distal end of each deformation preventing portion 42 is not reinforced by the rib 44 so as to have elasticity. Each deformation preventing portion 42 has an engagement protrusion 43 formed on the outer peripheral side of the distal end thereof. Each engagement protrusion 43 includes an inclined face 43*a* projecting outward and a vertical wall face 43*b* formed at the terminal end of the inclined face 43*a*. The engagement protrusion 43 is to be supported on a locking arm 33 at the central portion in the direction of the width thereof. The hood 30 has two engagement grooves 35 each extending inwardly from the base of each locking arm 33 so that each engagement groove 35 is contiguous to the inside and outside of the hood 30. The engagement grooves 35 are disposed to correspond to the respective engagement protrusions 43. Since the engagement protrusions 43 are received in the respective engagement grooves 35 inside the hood 30, the height of each engagement protrusion 43 is set so that the distance between the tops of the engagement protrusions 43 is larger than the distance between the inner faces of the locking arms 33. Each locking arm 33 has a guide groove 36 formed in the distal end of the inner face thereof along an insertion path of the engagement protrusion 43. Each guide groove 36 becomes shallower as it goes inward.

In the attaching of the cap 40 to the connector 10, the ribs 44 are inserted along the inner faces of the positioning ribs 32 of the hood 30 respectively. In this case, the engagement protrusions 43 of the deformation preventing portions 42 are first inserted into the respective guide grooves 36 so that the cap 40 is positioned. Then, the cap 40 is gradually inserted into the hood 30. When each engagement protrusion 43 is inserted with its positional shift in the direction of the width restricted by the guide groove 36, the mountain ribs 44 are inserted along the inner faces of the respective positioning ribs 32.

A positional shift of the engagement protrusions 43 is not caused once the ribs 44 have been inserted in the inner faces of the respective positioning ribs 32. Then, the guide grooves 36 are not necessary, and each engagement protrusion 43 climbs over the inclined face of the guide groove 36 to be gradually pushed inward such that the distal end of each locking arm 33 flexes inward. When the cap 40 is pushed in such that the ribs 44 have been completely inserted in the hood 30, the vertical wall face 43*b* of each engagement protrusion 43 is located at the distal end of the engagement groove 35 of the hood 30, as shown in FIG. 3. Each deformation preventing portion 42 then returns to its normal shape such that the engagement protrusions 43 invade the engagement grooves 35, engaging the engagement protrusions 34, respectively. Consequently, the protecting cap 40 is securely held on the connector 10 and can be prevented from falling off during transportation. Furthermore, since the deformation preventing portions 42 are provided, an engagement structure need not be provided separately.

The locking arms 33 are located outside the respective deformation preventing portions 42 when the protecting cap 40 has been attached to the connector 10, as described above. Accordingly, each locking arm 33 abuts against the deformation preventing portion 42 when something strikes against the outer face of each locking arm during transportation and a force acts one each locking arm 33 to cause it to be pushed inward. However, the deformation preventing portions 42 are reinforced by the ribs 44 formed on the inside thereof. Consequently, the deformation preventing portions 42 do not easily flex inward and prevent further flection of the respective locking arms 33. Thus, even when a force pushing each locking arm 33 inward is too large, each locking arm is prevented from flexing to such a degree that it cannot return to its normal shape.

The protecting cap 40 is designed not to project outward of the positioning ribs 32 and to pass through the mounting hole W of the panel P, as described above. Furthermore, the distal end of each locking arm 33 is disposed slightly away from the outer face of the deformation preventing portion 42 when the protecting cap 40 has been attached to the connector 10. Accordingly, each locking arm 33 can flex inwardly. As described above, the engagement protrusion 34 of each locking arm 33 abuts against the edge of the panel P defining the mounting hole W such that the distal end of each locking arm 33 flexes slightly inward when the connector 10 is mounted in the hole W. As the result of slight flection of each locking arm 33, the connector 10 can be mounted on the panel with the cap 40 being attached thereto when the connector 10 has the construction that the deformation preventing portions 42 are provided for protecting the locking arms 33.

The protecting cap 40 is detached from the connector when the female connector is connected to the male connector. Since the deformation preventing portions 42 are provided on the cap 40, there is nothing left inside each locking arm 33 when the cap 40 has been detached from the connector 10. Consequently, the interior of the hood 30 can be utilized for other purposes. Furthermore, a female screw thread 37 is provided to extend toward the open end in the hood 30. A male screw provided on the female connector is engaged with the female screw thread 37 so that the female connector is connected to the male connector.

Figure 4:
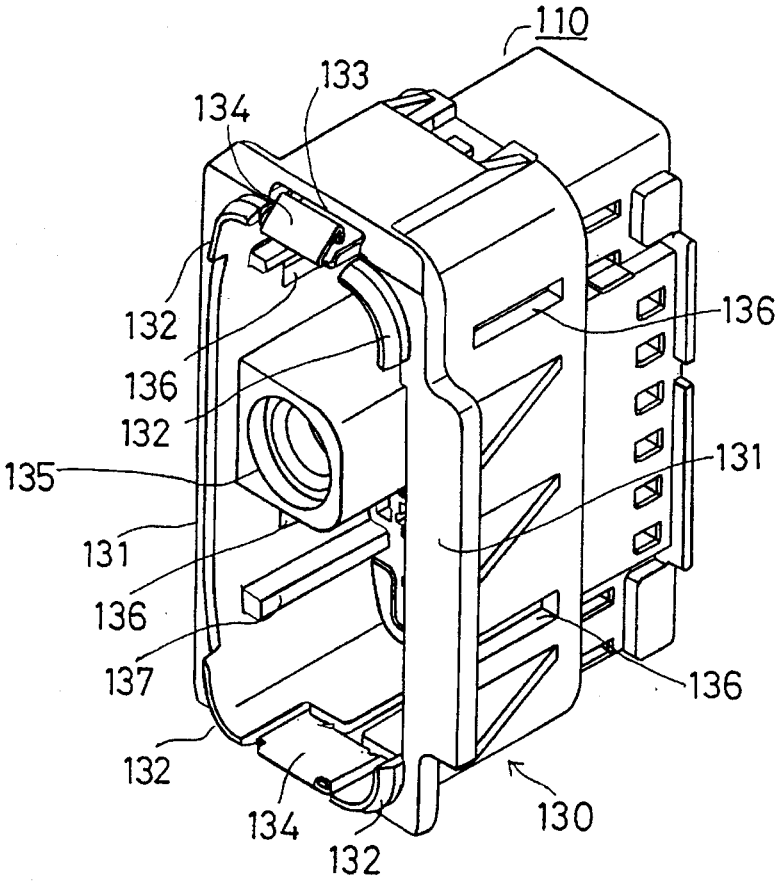
FIG. 4 is a perspective view of a second embodiment of the connector.
Figure 5:
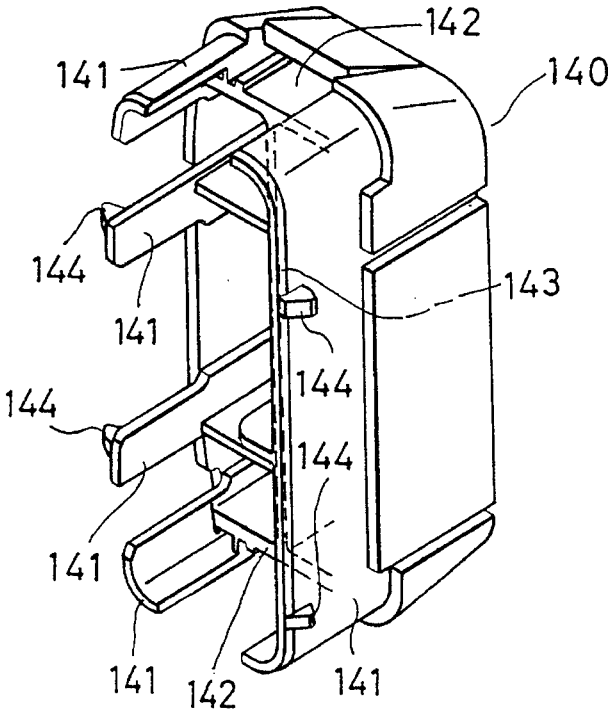
FIG. 5 is a perspective view of the protecting cap.
Figure 6:
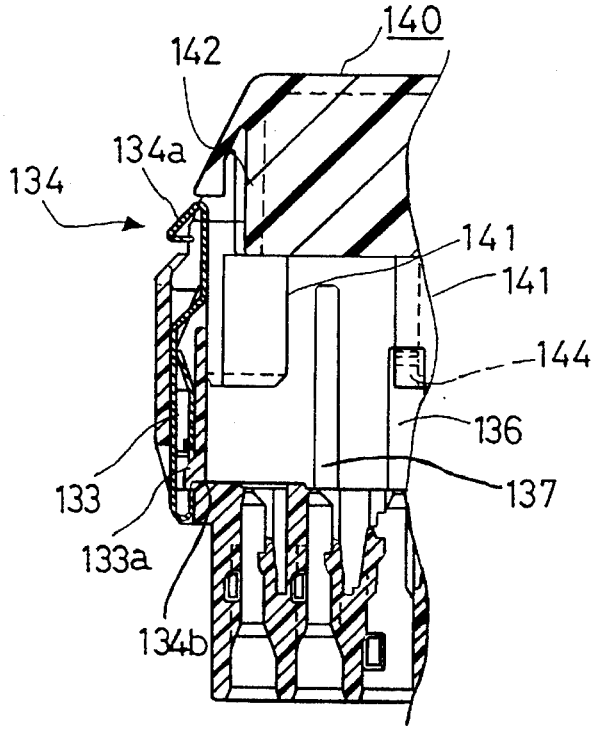
FIG. 6 is a partial sectional view of the connector and the protecting cap attached to the connector.
Figure 9:
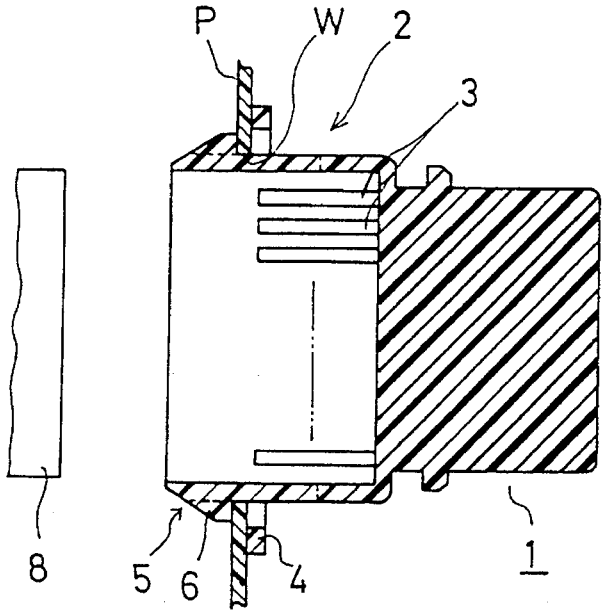
Fig. 9 PRIOR ART
FIG. 9 is a schematic sectional view of a conventional connector and protecting cap.

FIGS. 4 to 6 illustrate a second embodiment of the invention. The connector is provided with separate metal locking arms in the second embodiment while the locking arms 33 are formed integrally with the connector 10 in the first embodiment. The flange 131 is formed on the whole outer periphery of the open end of the hood 130. The plate-like positioning ribs 132 project forward from the corners of the hood 130. The hood 130 has two arms holding chambers 133 formed in the upper and lower walls to extend longitudinally through the walls, respectively. Each arm holding chamber 133 is inwardly bent such that the front end of the inner wall is lower than the outer wall thereof. Each arm holding chamber 133 has an engagement protrusion 133*a* formed on the rear portion of the inner wall to project outward.

Each locking arm 134 is formed by bending a band-shaped metal plate. The front end of each locking arm 134 is folded rearward such that the engagement protrusion portion 134*a* is formed. The rear end of each locking arm 134 is folded forward such that an engagement hole 134*b* into which the engagement protrusion 133*a* can be inserted is formed.

Each locking arm 134 is inserted into the arm holding chamber 133 from the end on which the engagement hole 134*b* is formed, and the engagement protrusion 133*a* is received in the engagement hole 134*b*, whereby each locking arm 134 is held in the arm holding chamber 133, as shown in FIG. 6. Since the front end of the inner wall of each arm holding chamber 133 is lowered inward relative to the outer wall thereof, the distal end of each locking arm 134 on which the engagement protrusion 134*a* is formed can readily flex into the hood 130. When the locking arms 134 have been held in the respective arm holding chambers 133, the engagement protrusions 134*a* project outward and the edge defining the mounting hole W of the panel P is held between the engagement protrusions 134*a* and the flange 131, whereby the engagement protrusions 134*a* engage the edge of the panel P.

A part of the inner side wall of the hood 130 is inwardly raised so that a female screw section 135 with the female screw thread projecting toward the open end is provided. Engagement grooves 136 and ribs 137 guiding the female connector are formed in the upper and lower portions of each of the right-hand and left-hand side walls. Each engagement groove 136 is contiguous to the inside and outside of the hood 130.

The protecting cap 140 has the shape of a dome so as to close the open end of the hood 130. The cap 140 has positioning ribs 141 each projecting from an opening of the cap to extend along the inner peripheral face of the hood 130. Central portions of upper and lower walls of each positioning rib 141 are notched forward and the width of each notched portion is slightly larger than that of the locking arm 134. Unnotched portions of the upper and lower walls serve as the deformation preventing portions 142 respectively. The ribs 143 reinforcing both deformation preventing portions 142 extend between the deformation preventing portions 142. A part of each positioning rib 141 is cut off so as not to interfere with the projecting portion formed on the side wall of the hood 130. The cap 140 has on the outer peripheral face of its distal end the engagement protrusions 144 formed to correspond to the respective engagement grooves 136 formed in the hood 130.

In the attaching of the protecting cap 140 to the connector 110, the cap 140 is inserted into the hood 130 from its side of the positioning ribs 141. When the positioning ribs 141 have been completely inserted in the hood 130, the engagement protrusions 144 invade the respective engagement grooves 136, thereby engaging the hood 130. FIG. 6 illustrates the state in which the engagement protrusions 144 are received within the respective engagement grooves 136. In this state, each deformation preventing portion 142 in inserted in the inside of the distal end of the locking arm 134 with a small gap therebetween.

In the state that the protecting cap 140 has been inserted in the hood 130, each locking arm 134 abuts against the deformation preventing portion located inside when something strikes against the outer face of each locking arm 134 during transportation such that a force pushing each locking arms 134 inward is applied thereto. However, since the deformation preventing portions 142 are reinforced by the ribs 143 formed on the inside thereof, the deformation preventing portions 142 do not readily flex inward such that further flection of each locking arm 134 is prevented. Consequently, each locking arm 134 can be prevented from flexing to such a degree that it cannot return to its normal shape even if the force pushing it inward is too large.

The distal end of each locking arm 134 is disposed slightly away from the outer face of the deformation preventing portion 142, and each positioning rib 141 is notched by the length corresponding to the width of the locking arm 134. Accordingly, each locking arm 134 can flex inward until its distal end abuts against the deformation preventing portion 142. Even if the connector 110 to which the cap 140 has been attached is inserted into the hole W of the panel P, the distal end of each locking arm 134 can flex inward when the engagement protrusion 134*a* of each locking arm 134 abuts against the edge of the panel P defining the hole W. Consequently, in this embodiment, too, the mounting of the connector is not disturbed even thought the protecting cap 140 is attached to the connector 110 and the deformation preventing portions 142 are provided for protecting the respective locking arms 134.

Since the deformation preventing portions 142 are provided on the cap 140 as in the foregoing embodiment, there is nothing left inside each locking arm 133 when the cap 40 has been detached from the connector 110. Consequently, the interior of the hood 130 can be utilized for other purposes.

Figure 7:
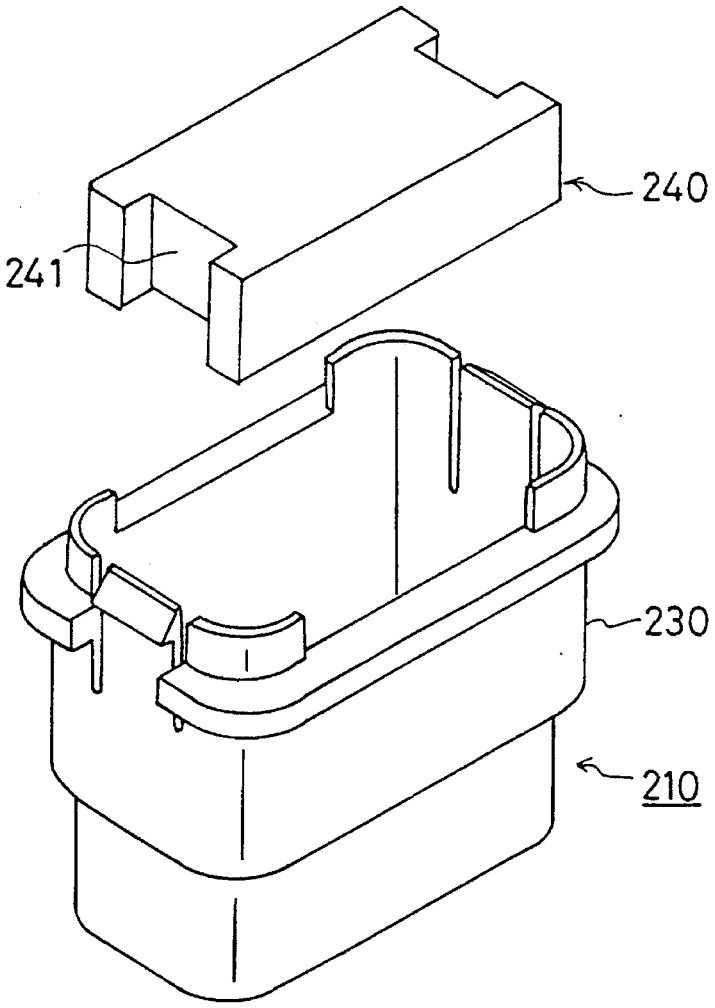
FIG. 7 is a perspective view of a modified form of the connector and the protecting cap.
Figure 8:
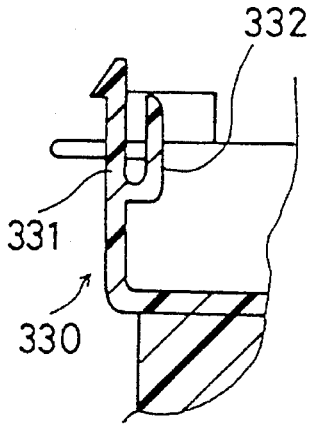
FIG. 8 is a partial sectional view of another modified form of the connector and the protecting cap.
Figure 10:
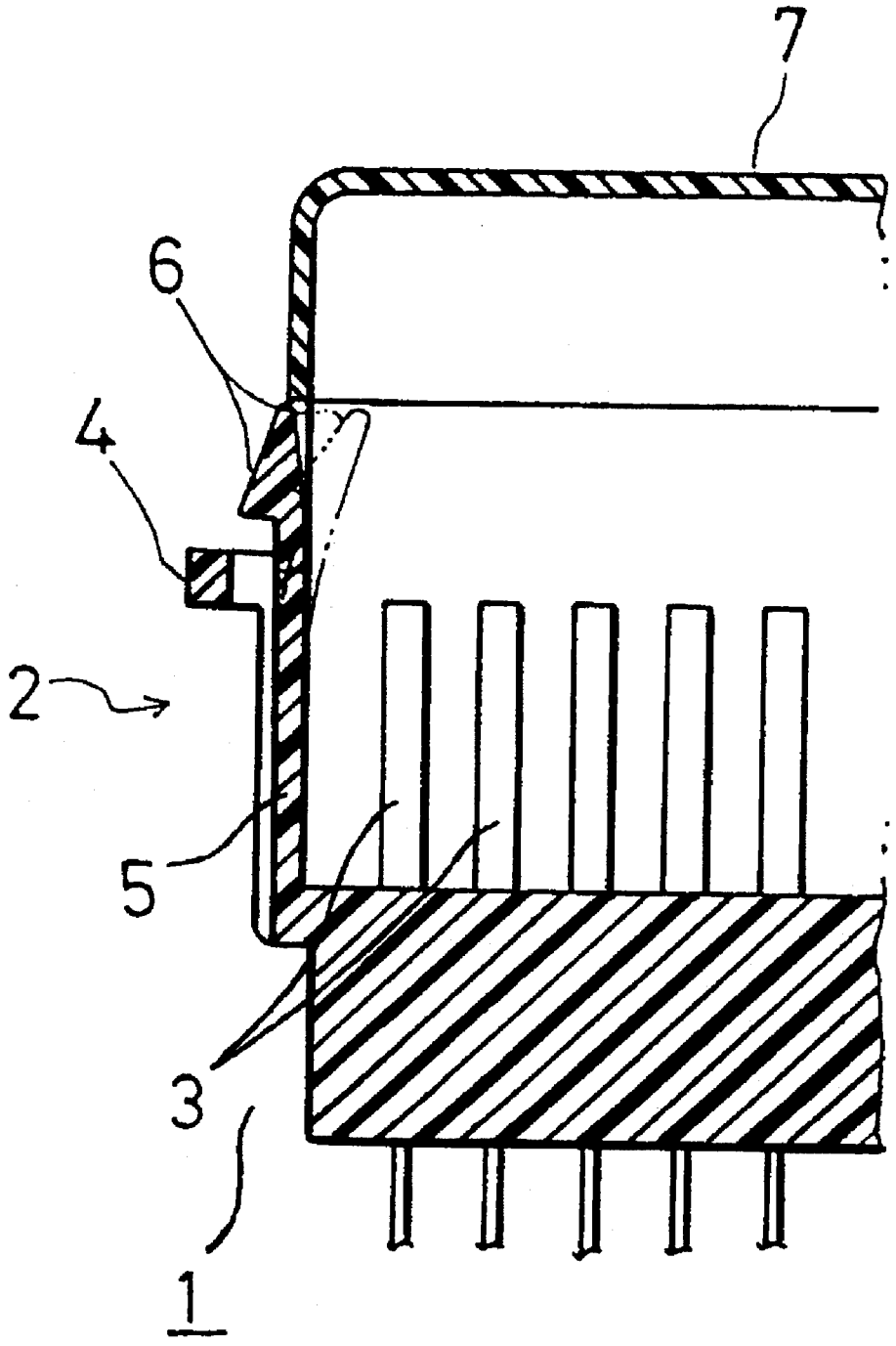
Fig. 10 PRIOR ART
FIG. 10 is a partial sectional view of the locking arm of the conventional connector.

In the foregoing embodiments, the deformation preventing portions are formed on the separate protecting cap detachable from the connector body, and the protecting cap has the shape of a dome so that the open end of the hood is completely covered by the cap. However, as shown in FIG. 7, the protecting cap 241 may be inserted into the hood 230 through its one end and the deformation preventing portion 241 may be attached between the locking arms 231 as a mandrel.

Furthermore, the deformation preventing portions 332 may be formed inside the respective locking arms 231 integrally with the hood 330. In this construction, however, each locking arm 331 projects outward or each deformation preventing portion 332 invades the hood 330. In the former case, the mounting hole W needs to be rendered large while the interior of the hood 330 is narrowed in the latter case.

Both of the locking arms need not be elastic. One of the locking arms may be elastic and the other locking arm may be a rigid engagement claw. In this case, one deformation preventing portion is provided.

The foregoing disclosure and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. An electrical connector comprising:

a) a body having a front opening, and a plurality of terminals supported within said body and capable of being fitted to counterpart terminals, respectively;

b) a pair of locking arms each disposed at the outer periphery of said body and capable of flexing inwardly and outwardly relative to the front opening of the body, each locking arm having an engagement protrusion which will engage an edge defining a mounting hole when the connector is inserted into the mounting hole; and c) a pair of deformation preventing portions provided to the inside of the locking arms, respectively, a gap being defined between each of said deformation preventing portions and the corresponding locking arm, the gap allowing the corresponding locking arm to flex inwardly while the protrusion of the corresponding locking arm is engaged with the edge defining the mounting hole such that the deformation preventing portions limit deformation of the locking arms by engaging the locking arms, respectively when the locking arms have been flexed inwardly.

2. A connector according to claim 1, wherein each of said deformation preventing portions is an integral part of a protecting cap attached to the body of the connector at said front opening thereof.

3. A connector according to claim 2, wherein each of said deformation preventing portions of the protecting cap projects inside of the connector body and has an engagement protrusion engaging the connector body at a location within the connector body.

4. A connector according to claim 3, wherein each of said deformation preventing portions has a resilient distal end, and said engagement protrusion of the deformation preventing portion is integral with the distal end and engages the inner peripheral surface of the connector body.

5. A connector according to claim 4, wherein each of said locking arms has an inside surface defining a guide groove for guiding the engagement protrusion of a respective one of said deformation preventing portions into the connector body as said cap is fitted to the connector body.

* * * * *